US008240968B2

(12) United States Patent
Hopkins et al.

(10) Patent No.: US 8,240,968 B2
(45) Date of Patent: Aug. 14, 2012

(54) AUTOMATED ROD HANDLING SYSTEM

(75) Inventors: James R. Hopkins, Fishers, IN (US); Calvin Moore, Noblesville, IN (US); Jason Hause, Indianapolis, IN (US); Alan Benedict, Bargersville, IN (US)

(73) Assignee: Laibe Corporation, Indianapolis, IN (US)

( * ) Notice: Subject to any disclaimer, the term of this patent is extended or adjusted under 35 U.S.C. 154(b) by 403 days.

(21) Appl. No.: 12/589,615

(22) Filed: Oct. 26, 2009

(65) Prior Publication Data

US 2010/0104401 A1 Apr. 29, 2010

Related U.S. Application Data

(60) Provisional application No. 61/197,451, filed on Oct. 27, 2008.

(51) Int. Cl.
*E21B 19/00* (2006.01)
*E21B 19/15* (2006.01)
*E21B 19/20* (2006.01)

(52) U.S. Cl. ..... 414/22.55; 414/22.62; 414/730; 901/9; 901/16; 700/253

(58) Field of Classification Search ..... 175/52, 175/85; 211/70.4; 414/22.51–22.59, 22.61–22.62, 414/22.65–22.69, 22.71, 23, 267, 730, 745.1, 414/745.4, 745.5, 745.6, 745.7, 745.8, 746.3, 414/746.4; 700/253–254; 901/14, 16, 18, 901/9

See application file for complete search history.

(56) References Cited

U.S. PATENT DOCUMENTS

| | | | | |
|---|---|---|---|---|
| 3,145,786 | A * | 8/1964 | O'Neill et al. | 175/85 |
| 3,913,753 | A | 10/1975 | Swartz et al. | |
| 3,943,343 | A * | 3/1976 | Irie | 318/568.15 |
| 4,403,898 | A | 9/1983 | Thompson | |
| 4,420,812 | A * | 12/1983 | Ito et al. | 700/252 |
| 4,621,974 | A | 11/1986 | Krueger | |
| 4,684,314 | A | 8/1987 | Luth | |
| 4,725,179 | A | 2/1988 | Woolslayer et al. | |
| 4,822,230 | A | 4/1989 | Slettedal | |
| 5,174,389 | A | 12/1992 | Hansen | |
| 5,430,643 | A * | 7/1995 | Seraji | 700/263 |
| 5,687,804 | A | 11/1997 | Lappalainen | |
| 6,074,153 | A | 6/2000 | Allen | |
| 6,298,927 | B1 * | 10/2001 | Back | 175/52 |
| 6,543,551 | B1 | 4/2003 | Sparks et al. | |

(Continued)

FOREIGN PATENT DOCUMENTS

DE 10206645 A1 * 6/2007

(Continued)

*Primary Examiner* — Gregory Adams
(74) *Attorney, Agent, or Firm* — Krieg DeVault LLP

(57) ABSTRACT

A system includes a rack with rows for storing drill pipe, and a moveable structure having a control support coupled to an upper portion and a lifting device coupled to a lower portion. The moveable structure travels along a guide for positioning adjacent any of the rows. The control support includes a pivoting actuator, a rotating actuator, an extension arm having a drill pipe capture actuator, and an extension actuator. The lifting device includes a lifting actuator that raises a stack of drill pipe. The system further includes a controller that interprets a control support state including actuator positions and a position index value, and records a position description including the control support state corresponding to the position index value. The controller interprets a position request signal and provides actuator control signals in response to the position request signal and the position description.

14 Claims, 16 Drawing Sheets

U.S. PATENT DOCUMENTS

| | | | | |
|---|---|---|---|---|
| 6,543,555 | B2 | 4/2003 | Cassagrande | |
| 6,779,614 | B2 | 8/2004 | Oser | |
| 6,845,295 | B2 * | 1/2005 | Cheng et al. | 700/245 |
| 6,845,825 | B2 | 1/2005 | Bischel et al. | |
| 6,922,611 | B2 * | 7/2005 | Lapham | 700/245 |
| 7,140,453 | B2 * | 11/2006 | Ayling | 175/52 |
| 7,404,697 | B2 | 7/2008 | Thompson | |

FOREIGN PATENT DOCUMENTS

| | | | | |
|---|---|---|---|---|
| EP | 171368 | A | * | 2/1986 |
| SU | 941539 | B | * | 7/1982 |
| WO | WO 9855728 | A1 | * | 12/1998 |
| WO | WO 2007063568 | A1 | * | 6/2007 |
| WO | WO 2007115375 | A1 | * | 10/2007 |

* cited by examiner

2328

| Position Descriptions | | | |
|---|---|---|---|
| Position Index Value | Actuator 1 Position | Actuator 2 Position | Actuator 3 Position |
| Preliminary (1) | $f_{11}(t,d)$ | $f_{21}(t,d)$ | $f_{31}(t,d)$ |
| On-hole (2) | $f_{12}(t,d)$ | $f_{22}(t,d)$ | $f_{32}(t,d)$ |
| Intermediate (3) | $f_{13}(t,d)$ | $f_{23}(t,d)$ | $f_{33}(t,d)$ |
| Home (4) | $f_{14}(t,d)$ | $f_{24}(t,d)$ | $f_{34}(t,d)$ |
| Return to Rack (5) | $f_{15}(t,d)$ | $f_{25}(t,d)$ | $f_{35}(t,d)$ |

2322

FIG. 14

AUTOMATED ROD HANDLING SYSTEM

CROSS-REFERENCE TO RELATED APPLICATIONS

The subject application claims the benefit of U.S. Provisional Patent Application Ser. No. 61/197,451 filed on Oct. 27, 2008, the contents of which are hereby incorporated by reference in their entirety.

FIELD OF THE INVENTION

The present invention generally relates to rod or pipe handling systems, and more particularly but not exclusively relates to an automated system for handling drill pipe at a drill site location.

BACKGROUND

The convenient storage of pipe at a location near a drill site or wellsite bore, and delivery of the pipe to the bore is a long known challenge in virtually all drilling industries. Presently known systems rely on manual operation for many of the steps taken to transport and reorient pipe from a pipe storage rack to an "on-hole" position. However, these manual systems create the potential for misconnection of the pipe, and also expose personnel to close proximity with heavy equipment and the potential dangers that accompany such exposure. Therefore, improvements in the current technology are desirable.

SUMMARY

The present invention generally relates to rod or pipe handling systems, and more particularly but not exclusively relates to an automated system for handling drill pipe at a drill site location.

A unique system and apparatus is provided for delivering pipe from a rack to an on-hole position, and for returning the pipe from the on-hole position to the rack. Certain embodiments present a pipe from the rack to an on-hole position, or the reverse, in a fully automated operation, present the pipe to intermediate positions between the rack and the on-hole position, adapt to multiple rows of a rack without operator intervention, and learn positions for presenting the pipe from an operator and can repeat the learned positions automatically.

Further embodiments, forms, objects, features, advantages, aspects, and benefits shall become apparent from the following description and drawings.

BRIEF DESCRIPTION OF THE DRAWINGS

FIG. 14 is an illustration of position descriptions for a system for automated rod handling.

DESCRIPTION OF ILLUSTRATIVE EMBODIMENTS

Figure 1:
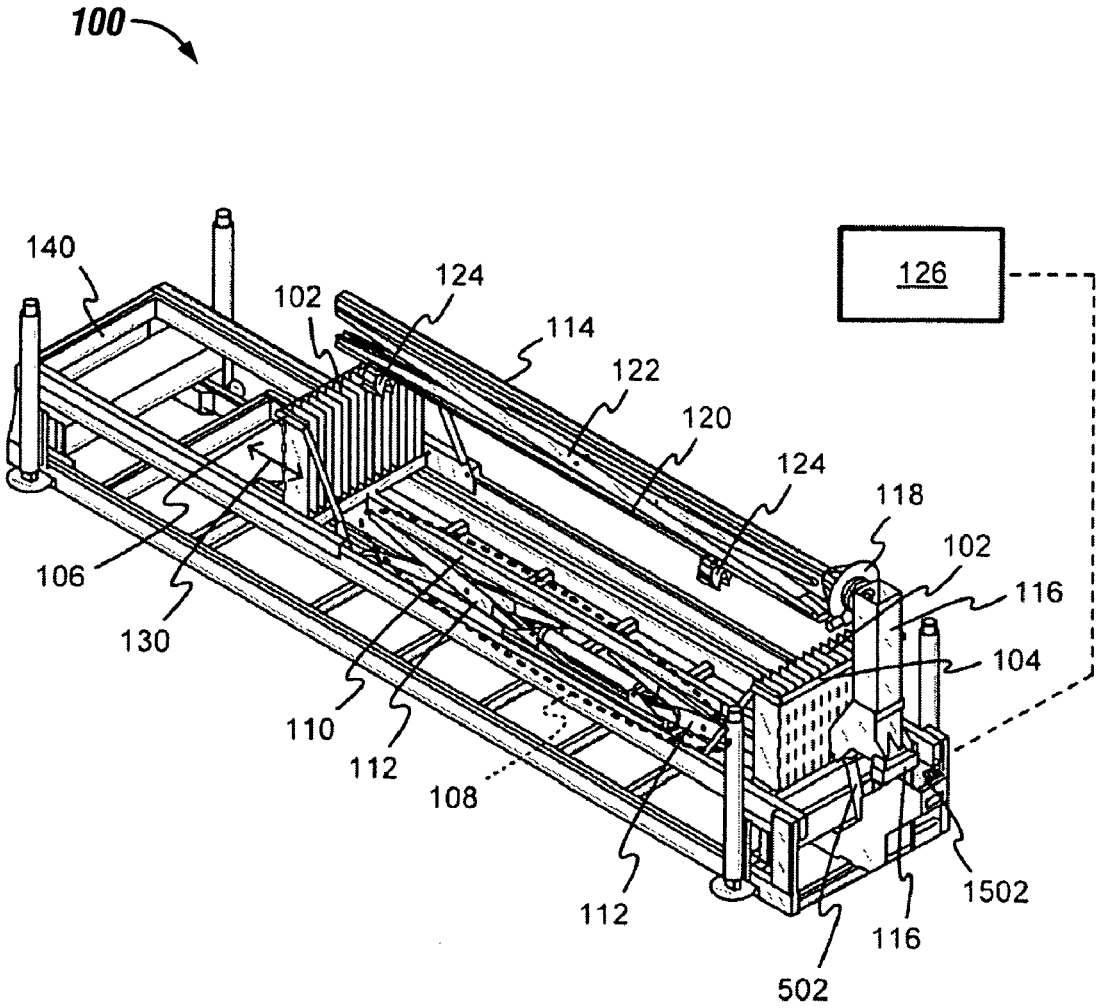
FIG. 1 is a perspective view of a system for automated rod handling according to one form of the invention in an initial operational state.

For the purposes of promoting an understanding of the principles of the invention, reference will now be made to the embodiments illustrated in the drawings and specific language will be used to describe the same. It will nevertheless be understood that no limitation on the scope of the invention is hereby intended, and that alterations and further modifications to the illustrated devices and/or further applications of the principles of the invention as illustrated herein are contemplated as would normally occur to one skilled in the art to which the invention relates. By way of example, the actuators described herein in association with the present invention are hydraulic actuators, but may alternatively be configured as any type of actuator known to those of skill in the art including, for example, electronic and pneumatic actuators.

Figure 2:
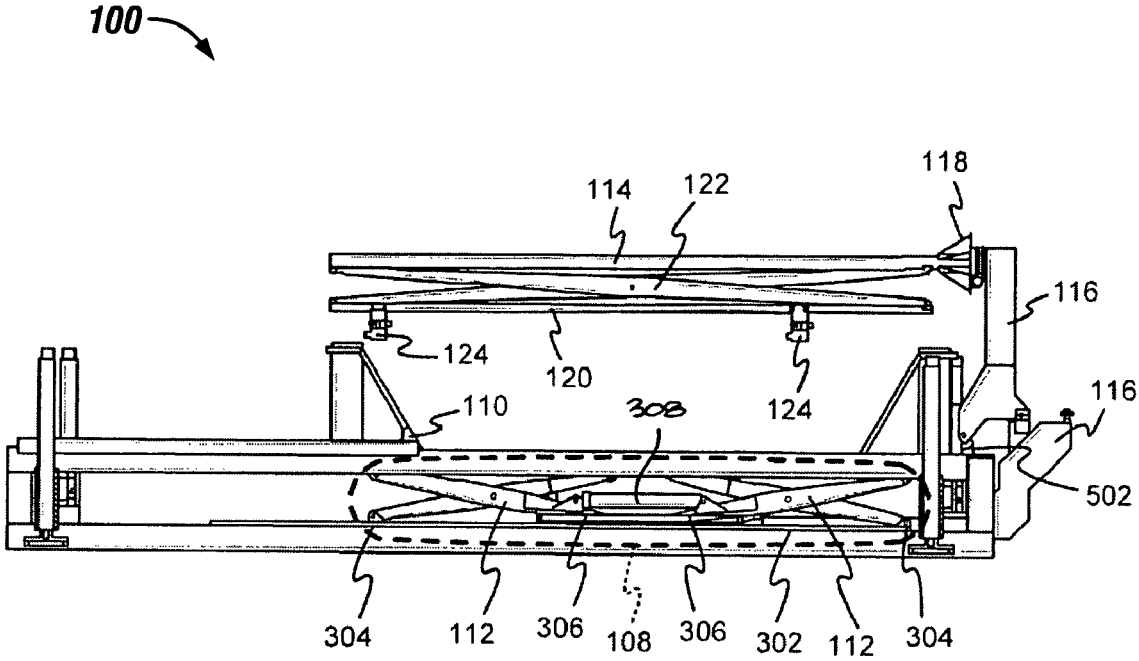
FIG. 2 is a side view of the system for automated rod handling illustrated in FIG. 1.

FIG. 1 is a perspective view of a system 100 for automated rod handling, and FIG. 2 is an end view of the system 100. The following describes the system 100 according to one form of the present invention which is configured to store and manipulate a plurality of drill pipes or rods 1002 (FIGS. 5-8) adjacent to a drilling rig (not shown), and to present the pipes 1002 to the drilling rig including presentation to an on-hole position. Drill pipe is stored in multiple columns that are stacked horizontally and directly on top of each other, with the columns separated by vertical dividers 102 at each end of the pipe. The dividers 102 are coupled to a second supported end 106, which may be referred to an end rack, a "rear bucket", or other terms generally understood in the art. The second end support 106 can be moved, for example, as shown by motion indicators 130, to accommodate drill pipes of various lengths and/or double or triple pipe lengths. The second end support 106 can be moved by hand via low friction rollers engaged along a track, by an actuator (not shown) such as a mechanical, hydraulic, or electric actuator, or by other suitable actuator devices.

The pipe storage system, including the vertical dividers 102, a first supported end 104 and a second supported end 106, is fixed to the structure of the frame body 140. The pipe columns are supported by the pipe storage system 102, 104, 106 at each end, while leaving the middle or intermediate portion of the pipe exposed to a pipe lifting mechanism 108 from below, details of which will be set forth below.

The system 100 includes a pipe lifting mechanism 108 that generally includes a support base 302, a lifting beam 110, a hydraulic cylinder 308, and two pairs of scissor bars 112 including pivot joints 306 located at the ends of the support base 302 and the lifting beam 110, and rollers 304 at opposite ends of the scissor bars 112 (FIG. 2). The locations of the pivot joints 306 may be moved or modified to other configurations generally understood in the art that still allows for extension of the scissor bars 112. The pipe lifting mechanism 108 is actuated via a single hydraulic actuator 308 pinned to the inner lower scissor bars 112, with one attachment point to each pair of the scissor bars 112. The hydraulic cylinder 308 presses or actuates the scissor bars 112 to raise a lifting beam 110. The hydraulic cylinder may be any length dictated by the relative movement of the lifting beam 110 to the hydraulic cylinder stroke, and by the available lifting force of the hydraulic cylinder. In one embodiment, the hydraulic cylinder has a sixty-inch stroke. While the lifting actuator for the pipe lifting mechanism 108 is illustrated as a hydraulic cylinder, the lifting actuator may be any actuator understood in the art including, without limitation, a hydraulic, pneumatic, electrical, or mechanical lifting actuator.

Figure 4:
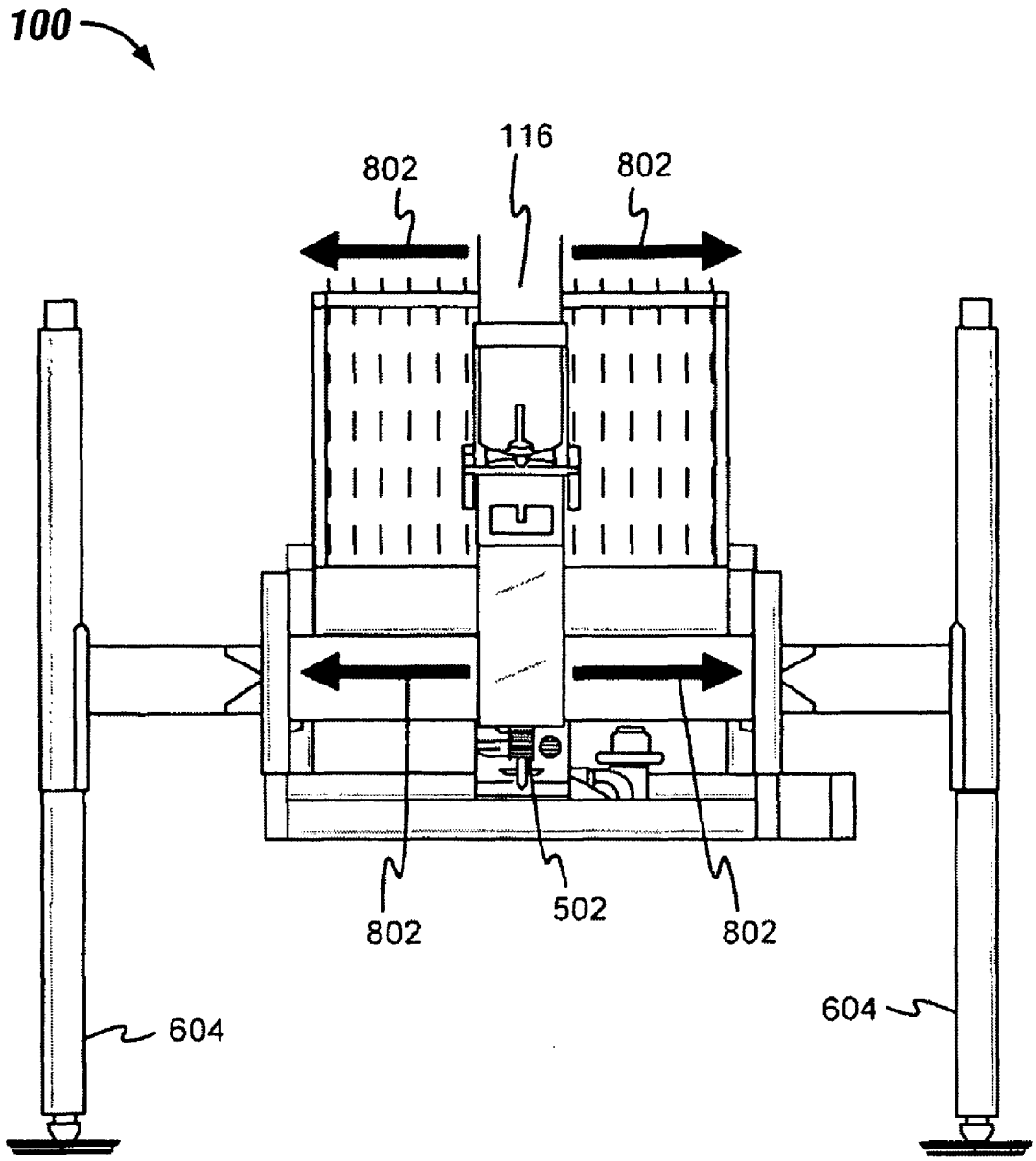
FIG. 4 is an end view of the system for automated rod handling illustrated in FIG. 3.
Figure 5:
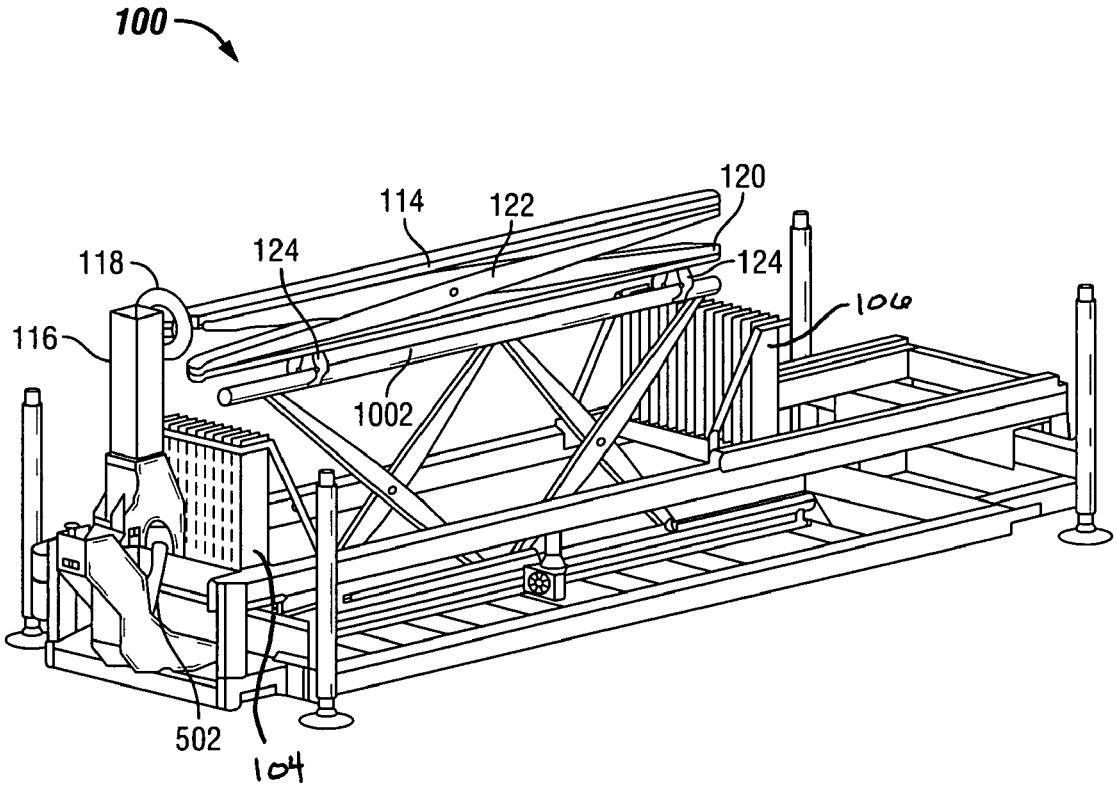
FIG. 5 is a perspective view of the system for automated rod handling in another operational state.

Certain aspects or elements of the pipe lifting mechanism 108, for example the lifting beam 110, are oriented parallel to an axis defined by drill pipe stored in the pipe storage system 102, 104, 106. The pipe lifting mechanism 108 is attached to the frame body 140 such that the pipe lifting mechanism 108 moves perpendicularly to stored drill pipes, allowing the pipe lifting mechanism 108 to be positioned beneath any selected pipe column (i.e., the space between vertical dividers 102). In one embodiment, the pipe lifting mechanism 108 is attached to a moveable structure 116. For example, referring to FIG. 4 illustrating an end view of one embodiment of the system 100, the moveable structure 116 moves in a manner consistent with the lateral motion indicators 802.

Figure 9:
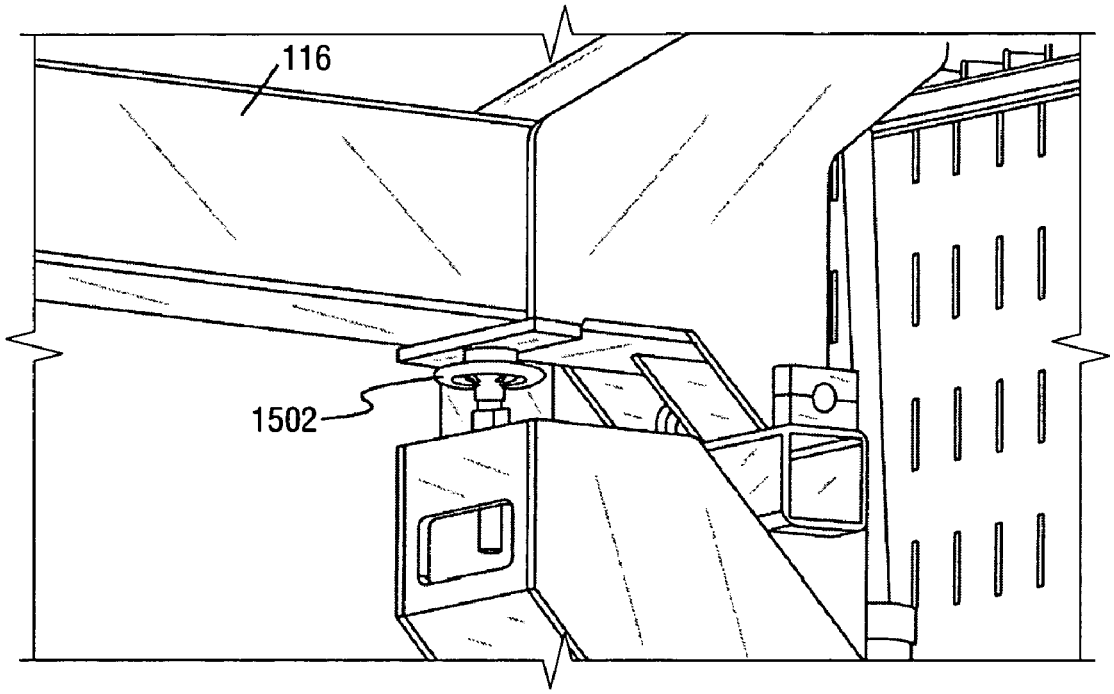
FIG. 9 is a perspective view of a vertical trim actuator for use in association with the system for automated rod handling.

Certain embodiments of the system 100 include a vertical adjustment 1502 (FIG. 9). The vertical adjustment 1502 provides a variable landing zone for the moveable structure 116 which in turn allows adjustment to the vertical position of the control arm 114, after pivoting up and setting on the vertical adjustment 1502. In FIG. 9, the vertical adjustment 1502 is configured as a hand wheel that moves up or down upon manual rotation. However, the vertical adjustment may comprise any adjustment mechanism generally understood in the art including, without limitation, a hydraulic or electronic actuator manually controlled by an operator or controlled automatically by a controller 126. The controller 126 may include a central processing unit (CPU) of a computer, but may also exist in hard-wiring or any other form generally known in the art. Additionally, the controller 126 may be distributed across multiple devices.

Figure 10:
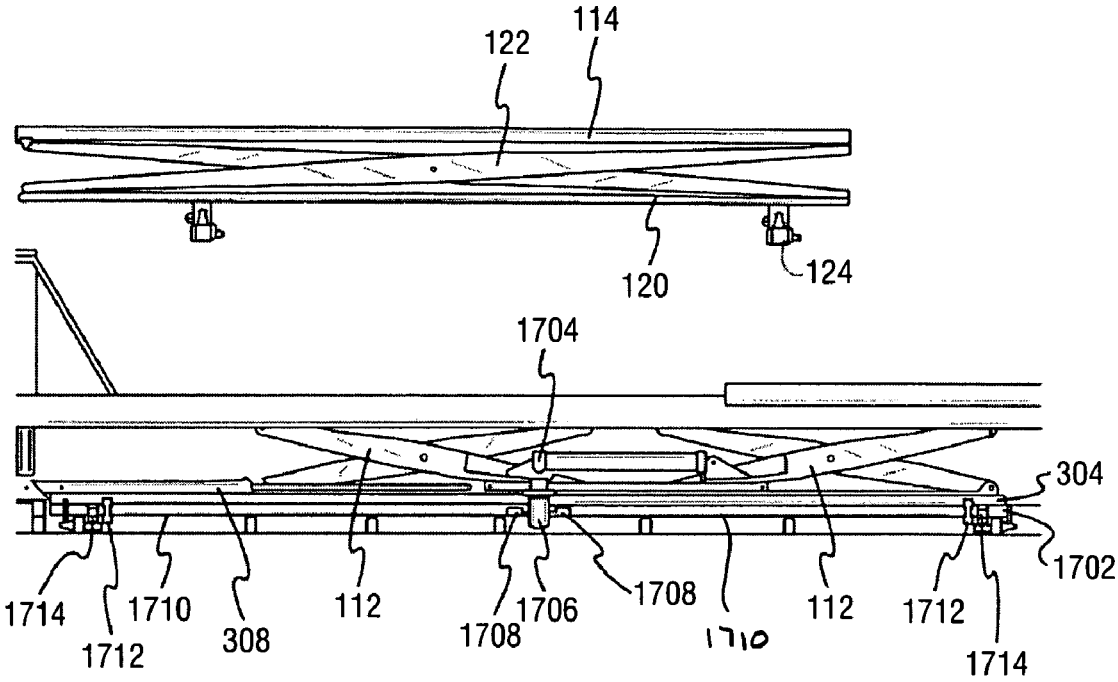
FIG. 10 is a side view of a portion of the system for automated rod handling.
Figure 11:
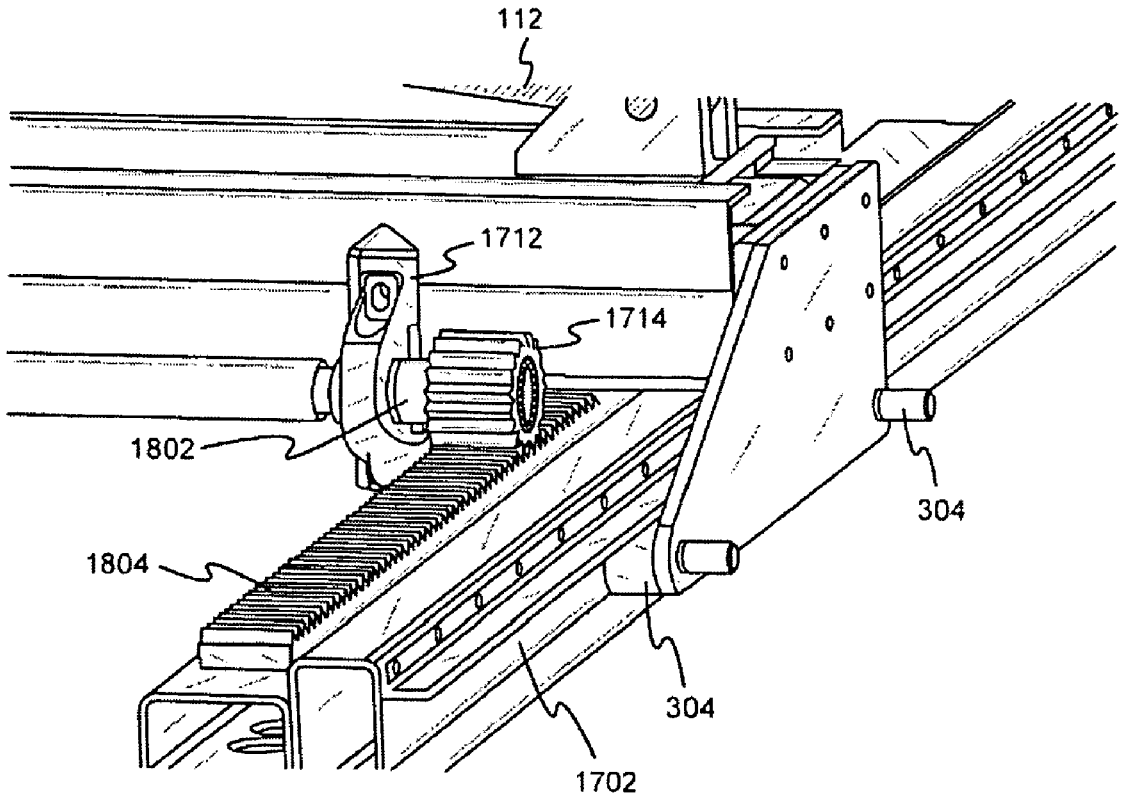
FIG. 11 is a perspective view of various mechanical drive components for use in association with the system for automated rod handling.
Figure 12:
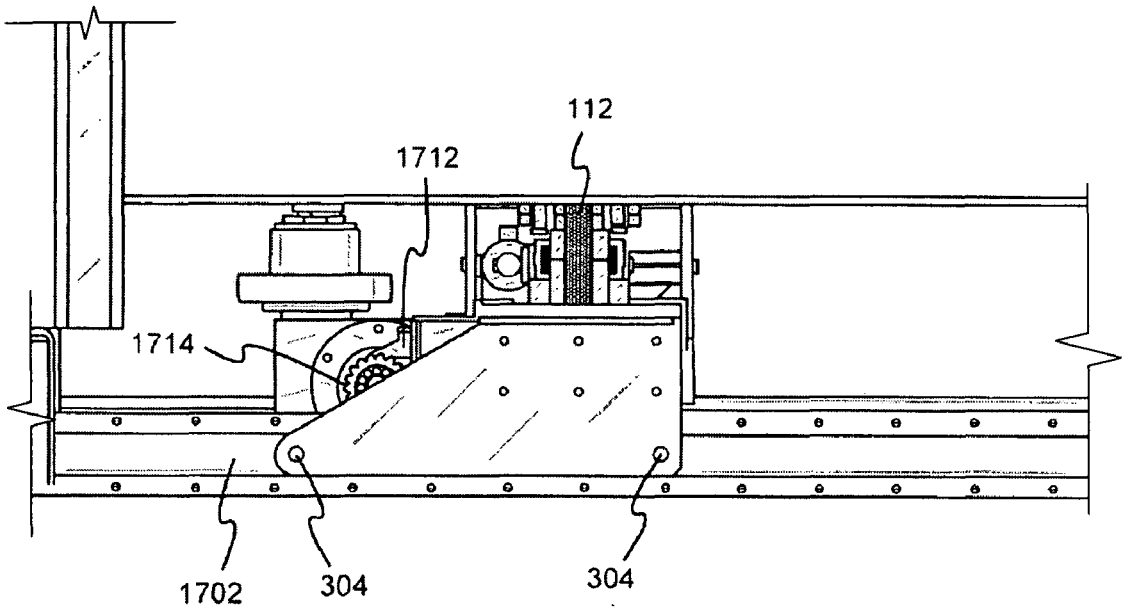
FIG. 12 is an end view of the mechanical drive components illustrated in FIG. 11.

Referring to FIG. 10, illustrated therein is one embodiment of mechanical components configured to control movement of the pipe lifting mechanism 108, both lift and lateral motion 802, and to control movement of a control arm 114. The pipe lifting mechanism 108 is supported by rollers 304 guided by tracks 1702, and is actuated by a hydraulic motor 1704 attached to a worm gear drive 1706 with two opposing output shafts 1708 located equidistant from the ends of the structure. Attached to the output shafts 1708 are torque tubes 1710 supported at the ends opposite the worm gear drive 1706 by pillow block bearings 1712, with pinion gears 1714 attached to shafts 1802 (FIG. 11) linking the torque tubes to the gears at the outer ends of the torque tubes. The gears mesh with gear racks 1804 (FIG. 11) that are fixed to the frame body 140.

Figure 6:
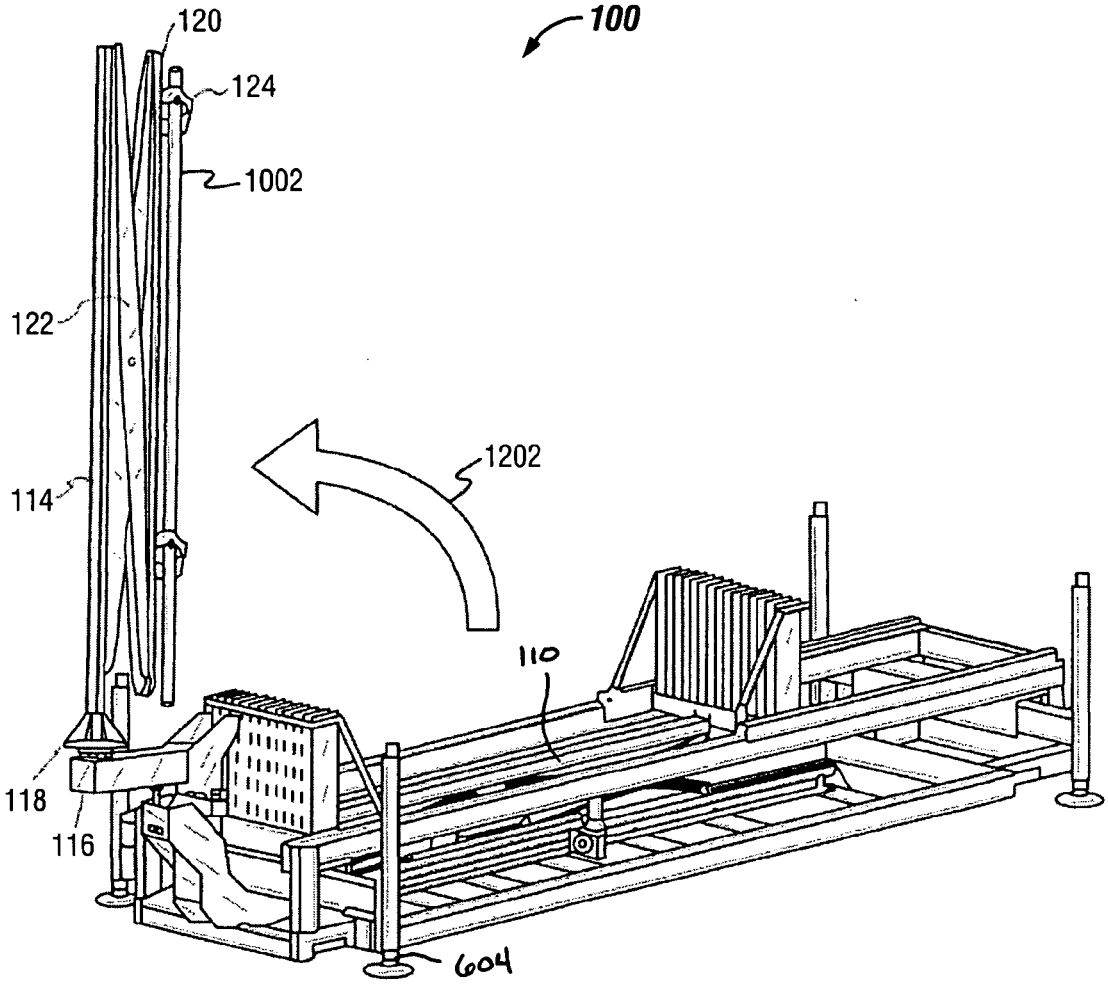
FIG. 6 is a perspective view of the system for automated rod handling in another operational state illustrating a pivoted control support.
Figure 7A:
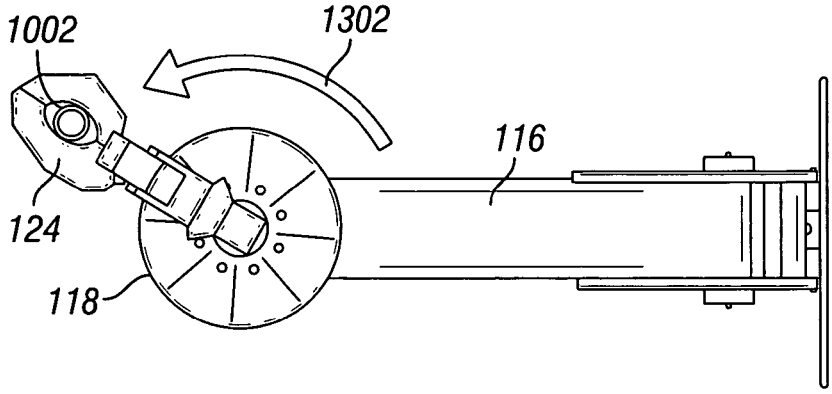
FIG. 7A is a plan view of the system for automated rod handling in another operational state illustrating a partially rotated control support.
Figure 7B:
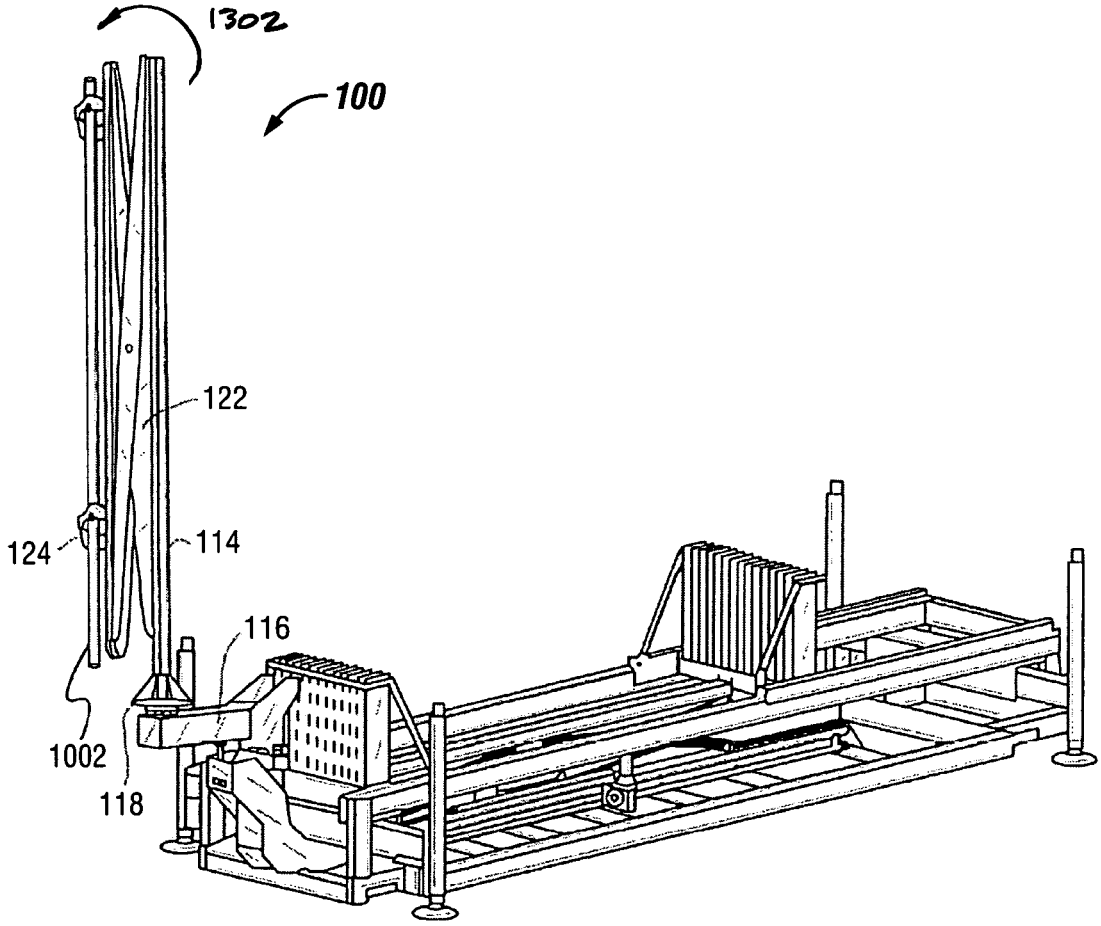
FIG. 7B is a perspective view of the system for automated rod handling in another operational state illustrating a fully pivoted control support.

A control arm 114 is pivotally (e.g., refer to motion indicator 1202 of FIG. 6) and rotatably (e.g., refer to motion indicator 1302 of FIGS. 7A and 7B) coupled to the movable structure 116 supporting the lifting beam 110. Because the base 118 of the control arm 114 is fixed to the movable structure 116, the relative position of the control arm base 118 to the pipe lifting mechanism 108 is fixed. The control arm 114 pivots from a horizontal orientation directly above a pipe column to a vertical orientation (e.g., as illustrated in FIG. 6), and rotates about an axis normal to the control arm base 118 (e.g., as illustrated in FIGS. 7A and 7B). The rotation 1302 and pivoting 1202 of the control arm 114 are described as separate sequential movements herein for clarity, but could occur in any order or simultaneously in certain embodiments of the system 100.

Figure 8:
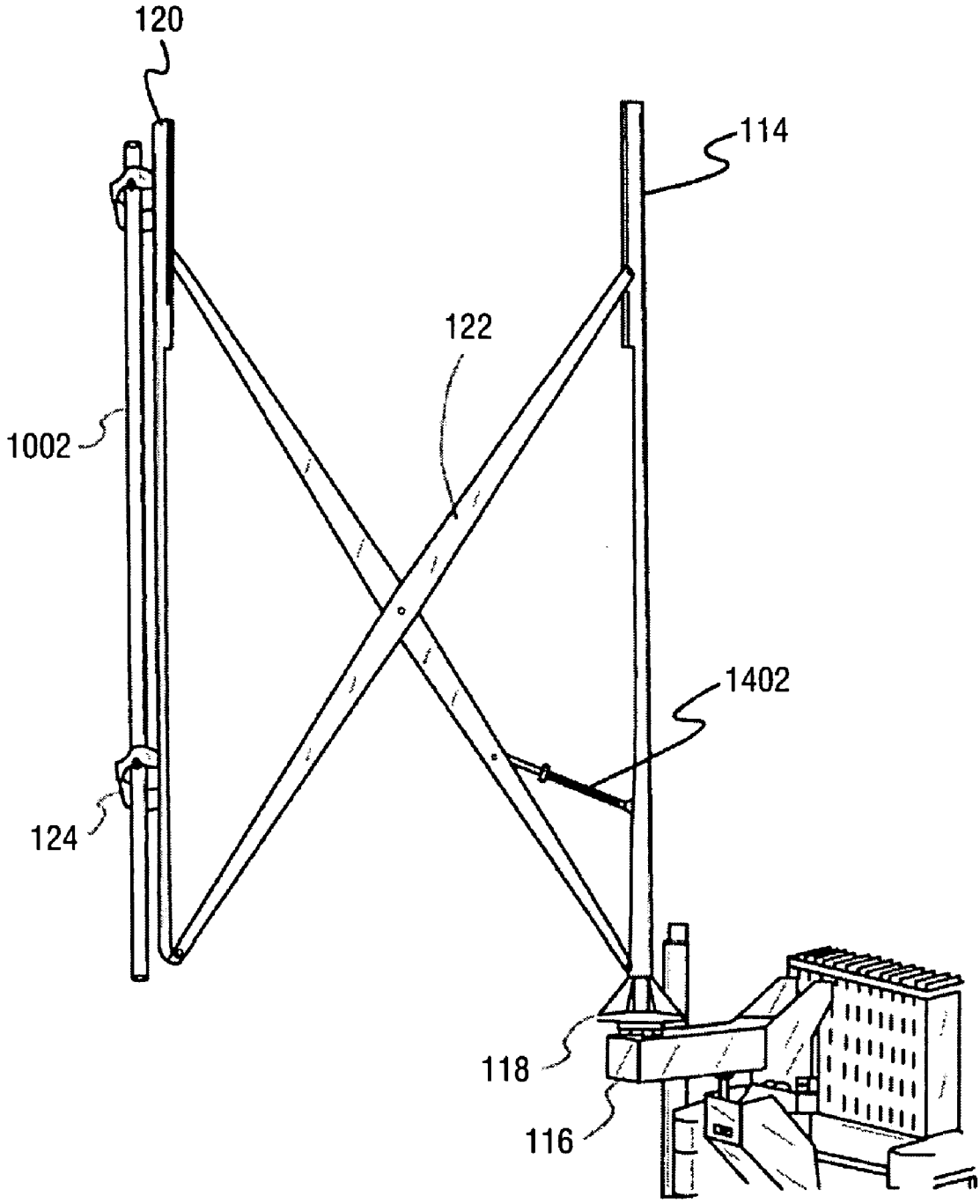
FIG. 8 is a perspective view of the system for automated rod handling in another operational state illustrating an extended extension arm.

The control arm 114 includes a back bar that is fixed to the control arm base 118 and an extendable bar 120 coupled by a single pair of scissor bars 122. The control arm 114 is pivoted by a first hydraulic actuator 502 (FIG. 5), and is rotated about the axis of the back bar by a second hydraulic actuator such as, for example, a hydraulic motor operably coupled to a swing drive. The extendable bar 120 is extended by action of a third hydraulic actuator 1402 (FIG. 8). Fixed to the extendable bar 120 are clamping jaws 124 for gripping the drill pipe 1002. The clamping jaws 124 are actuated by a hydraulic cylinders (not shown) associated with each pair of jaws 124. While clamping jaws 124 are illustrated, any drill pipe capture device may be utilized.

Figure 3:
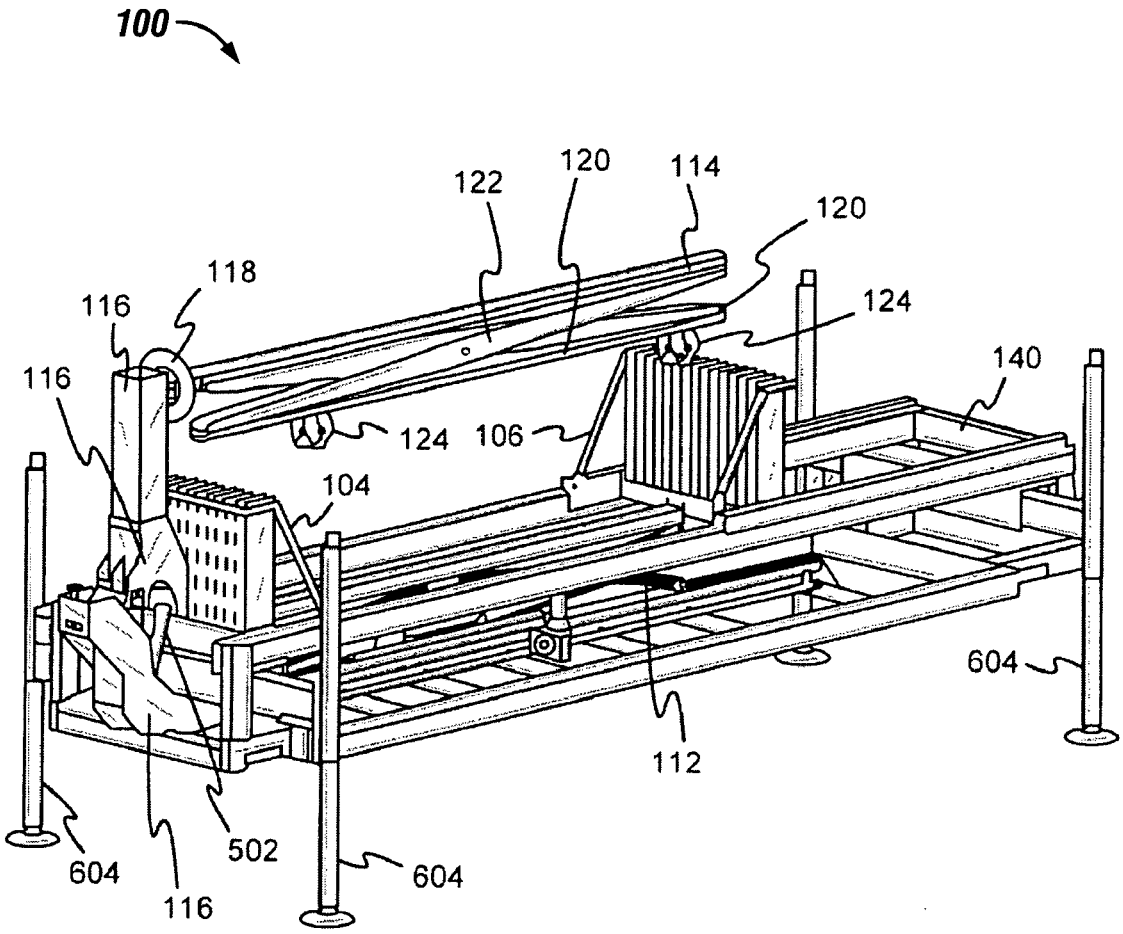
FIG. 3 is a perspective view of the system for automated rod handling in another operational state.

Referring to FIG. 3, a schematic illustration of an embodiment of the system 100 shows deployed support legs 604. The support legs 604 may be extended from the body 140 of the pipe handling apparatus for lateral stability and/or adjustable vertical support. The support legs 604 may be extended down vertically as shown to position the body 140 at a desired height. In one embodiment, the support legs 604 are lowered before a delivery vehicle drives out from under the body 140, thereby allowing the support legs 604 to lock into place without having to raise the body 140 of the apparatus from the ground. In one embodiment, the support legs 604 are operational with one or more actuators (not shown) and may be raised or lowered after deployment of the body 140 at the dill site.

Any of the actuators of the system 100 are amenable to electronic communication and control in certain embodiments. Some or all of the actuators may be at least partially in control of a controller 126. The system 100 may further include actuator position sensors (not shown) corresponding to any of the actuators that determine the position of the corresponding actuator and communicate position information to the controller 126.

Figure 13:
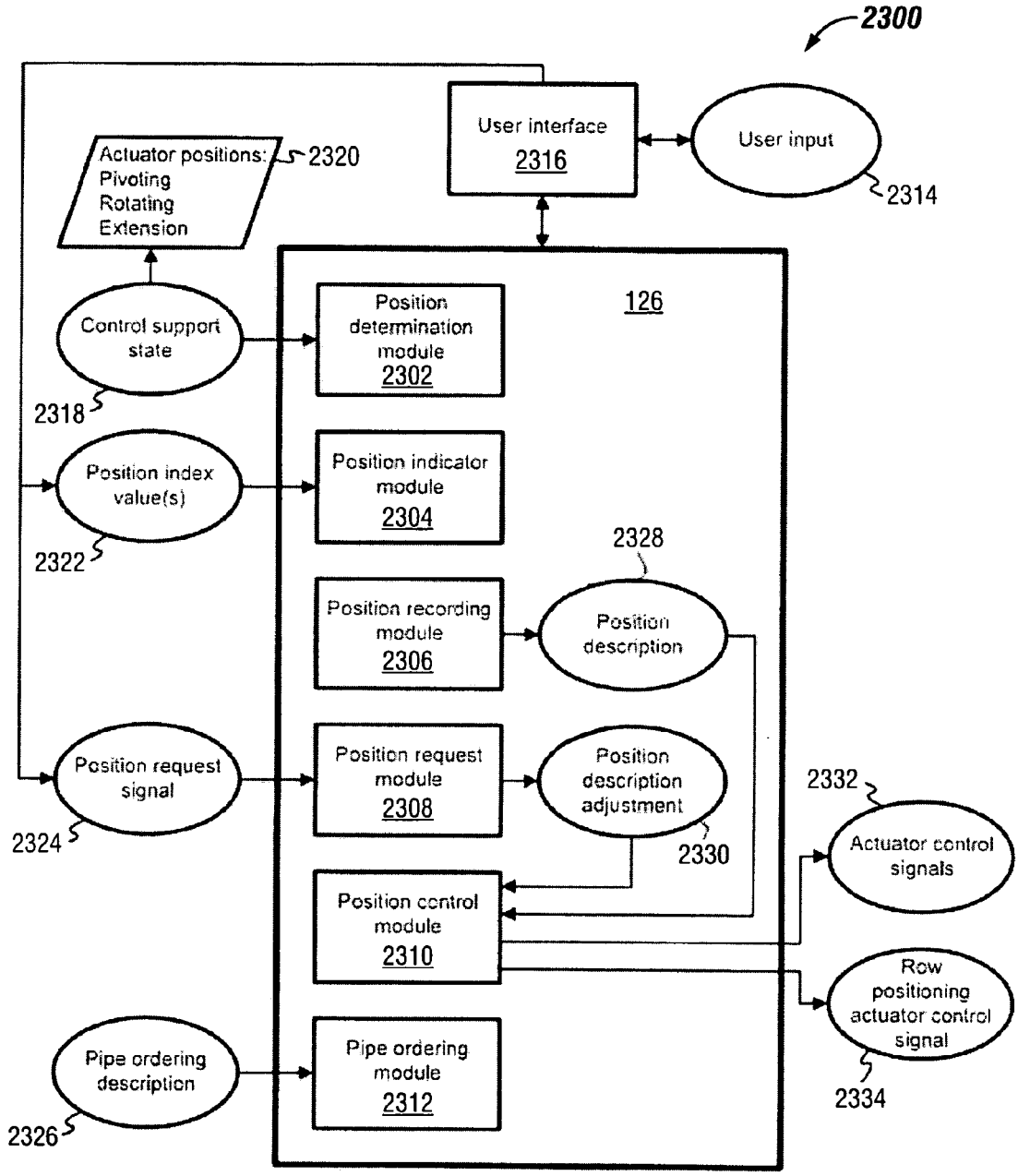
FIG. 13 is a schematic block diagram including a controller for a system for automated rod handling.

FIG. 13 is a schematic block diagram of a processing subsystem 2300 for automated pipe handling. The processing subsystem 2300 includes a controller 126 having a plurality of modules structured to functionally execute operations for automated pipe handling. The description herein utilizes modules to emphasize the independence of the functionality of the elements from the structure of the elements. A module may be computer instructions stored on a computer readable medium that cause the computer to perform operations when read by the computer, or a module may be at least partially implemented in hardware or by an operator. A module may be distributed across several computer components, within a single computer component, or may be distributed into computerized and non-computerized elements. In various embodiments, certain modules may be omitted, and additional modules may be included.

The controller 126 includes a position determination module 2302 that interprets a control support state 2318, including positions 2320 of the pivoting actuator, the rotating actuator, and the extension actuator. The controller 126 further includes a position indicator module 2304 that interprets a position index value 2322 and a position recording module 2306 that records a position description 2328 including the control support state 2318 corresponding to the position index value 2322. For example, the current position index value 2322 may indicate that a current position is the preliminary position, the control support state 2318 may include the actuator positions 2320 corresponding to the desired positions for the preliminary position, and the position recording module 2306 may create an entry in the position description 2328 with the actuator positions 2320 corresponding to the position index value 2322.

The controller 126 further includes a position request module 2308 that interprets a position request signal 2324. The position request signal 2324 may be generated from user input 2314 through a user interface 2316. The user interface 2316 may include any input device allowing a user (not shown) of the system 100 to communicate with the controller 126 including, without limitation, a keyboard, actuator lever, networked input device, and/or wireless device. The user interface 2316 may be a single device or a group of devices. For example, the user may generate a user input 2314 requesting a move to the on-hole position, and the user interface 2316 provides a position request signal 2324 indicating the on-hole position to the position request module 2308.

The controller 126 further includes a position control module 2310 that provides actuator control signals 2332 in response to the position request signal 2324 and the position descriptions 2328. For example, the position request signal 2324 may indicate that the on-hole position is desired, the position description 2328 includes a plurality of actuator positions corresponding to the on-hole position, and the position control module 2310 moves the system 100 actuators toward the actuator positions from the position description 2328. The position control module 2310 may utilize any other information understood in the art, including maximum speeds of actuator devices, safety and interlock switch information, and other data such that the actuator control signals 2332 may differ from the actuator positions described in the position description 2328. The actuator positions described in the position description 2328 may be utilized to determine error values to be utilized in a control scheme such as a proportional-integral controller or any other known control scheme.

In certain embodiments, the system 100 further includes a plurality of position index values 2322, each position index value corresponding to a specified operational stage of a drilling operation. The position index values 2322 may include, without limitation, a preliminary stage position, an on-hole position, an intermediate position, a home position, and/or a return to rack position. In certain embodiments, the position description 2328 includes a trajectory of actuator positions 2320 through space and/or time. For example, an actuator position stored in the position description 2328 may include a vector of positions versus time such that the actuator is operated at a desired speed and acceleration. In another example, an actuator position stored in the position description 2328 may include a parametric vector of positions such that the pipe 1002 travels through a pre-determined arc in space between positions.

In one embodiment, the position recording module 2306 records the position description 2328 in response to a teach and learn operation. For example, the user input 2314 indicates a start time and a stop time to the teach and learn operation, and a position index value 2322 corresponding to final position, and the position recording module 2306 records the actuator positions 2320 at the stop time in the position description 2328 corresponding to the final position. The teach and learn operation can include multiple positions, trajectories of actuator positions through time and/or space, and other features that will be clear to one of skill in the art with the benefit of the disclosures herein.

The controller 126 may include a pipe ordering module 2312 that interprets a pipe ordering description 2326, and the position control module 2310 may further provide a row positioning actuator control signal 2334 in response to the pipe ordering description 2326. For example, the system 100 may include dividers 102 forming six columns of pipe, and the pipe ordering description 2326 may include a sequence (1 2 3 4 5 6) indicating that the pipes should be removed and replaced sequentially from the rows one at a time (e.g. to ensure the pipe rack is balanced). The pipe ordering module 2312 may provide the pipe ordering description 2326 to the position control module 2310, which in turn provides a row positioning actuator control signal 2334 that ensures the moveable structure 116 is aligned on the proper pipe row each time. Other ordering schemes are understood in the art, and any ordering scheme for the pipe ordering description 2326 may be utilized. For example, and without limitation, a user input 2314 may be accepted for the pipe ordering description 2326, a pipe of a first size may be utilized first and pipe of a second size utilized second, pipe may be ordered to provide even wear across all pipes, and/or pipe segments having special features may be included at desired locations in the pipe strings.

In certain embodiments, the position request module 2308 provides a position description adjustment 2330 that adjusts the position description 2328 in response to the row positioning actuator control signal 2334. For example, the position description 2328 may include nominal actuator positions 2320 that achieve the position in the corresponding position index value 2322 when the moveable structure 116 is in a nominal position (e.g., aligned with a first row). In the example, the position request module 2308 may provide a position description adjustment 2330 such that the position in the corresponding position index value 2322 is achieved, accounting for the displacement of the moveable structure 116 to a present position (e.g., aligned with a third row). In one embodiment, the position control module 2310 adjusts the actuator control signal 2332 in response to the row positioning actuator control signal 2334 and/or the position description adjustment 2330.

FIG. 14 is an illustration of position descriptions 2328. The position descriptions 2328 include a plurality of position index values 2322, including a preliminary, on-hole, intermediate, home, and return to rack position index value 2322. In various embodiments, the position descriptions 2328 may include other position index values 2322, and/or may omit some of the illustrated position index values 2322. The position descriptions 2328 further include actuator positions corresponding to each of the position index values 2322, where the actuator positions may be simple position values and/or trajectories of the actuator positions through time and/or distance. For example, the actuator position $f_{23}(t,d)$ in the illustration is the trajectory of positions for actuator 2 corresponding to position index value 3 through time and distance. The data of the position descriptions 2328 may be stored on a computer readable medium, communicated to the controller 126 in real-time through a network or via user input, and may be stored in any format generally known in the art.

Figure 15:
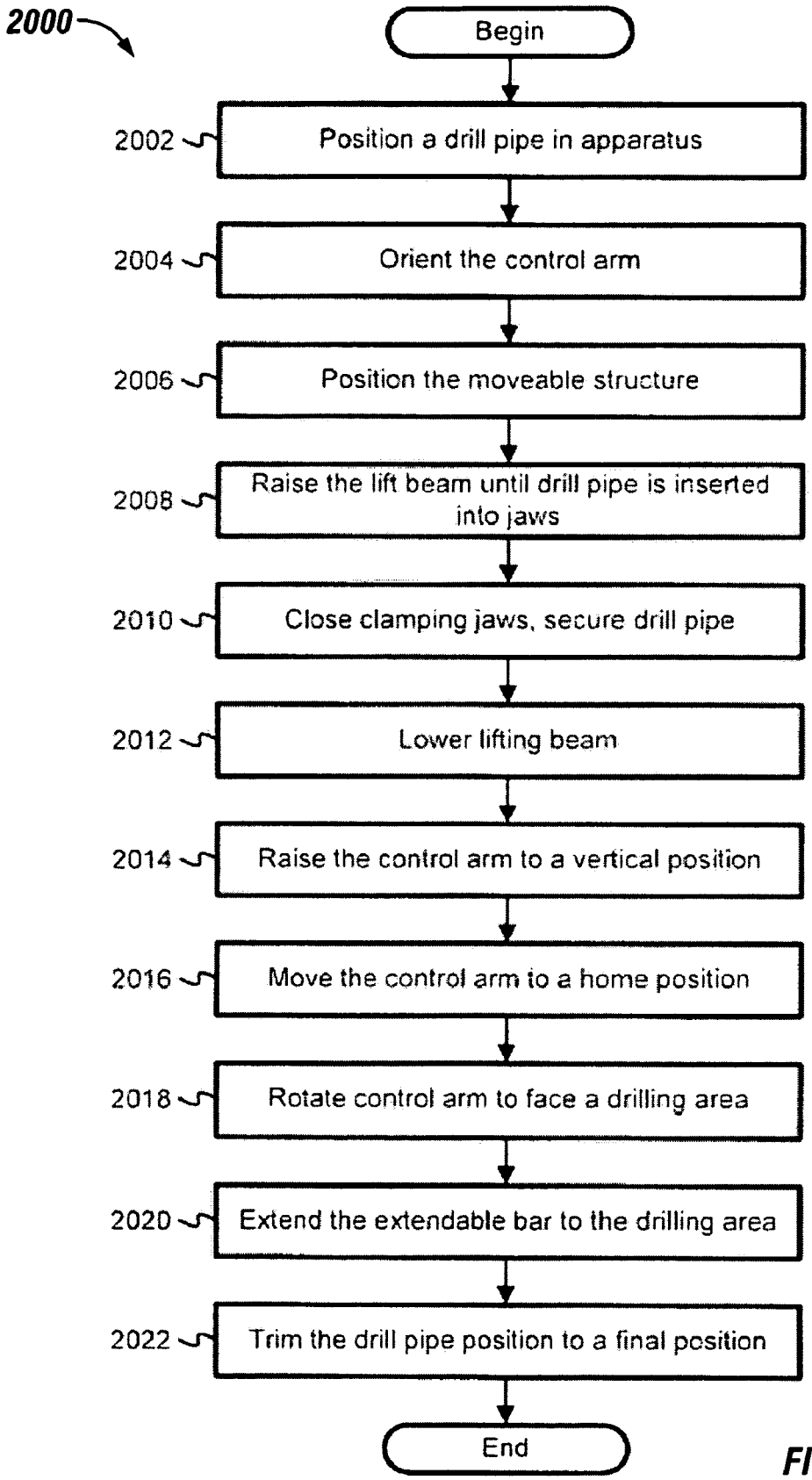
FIG. 15 is a schematic flow diagram of a procedure for automated rod handling.
Figure 16:
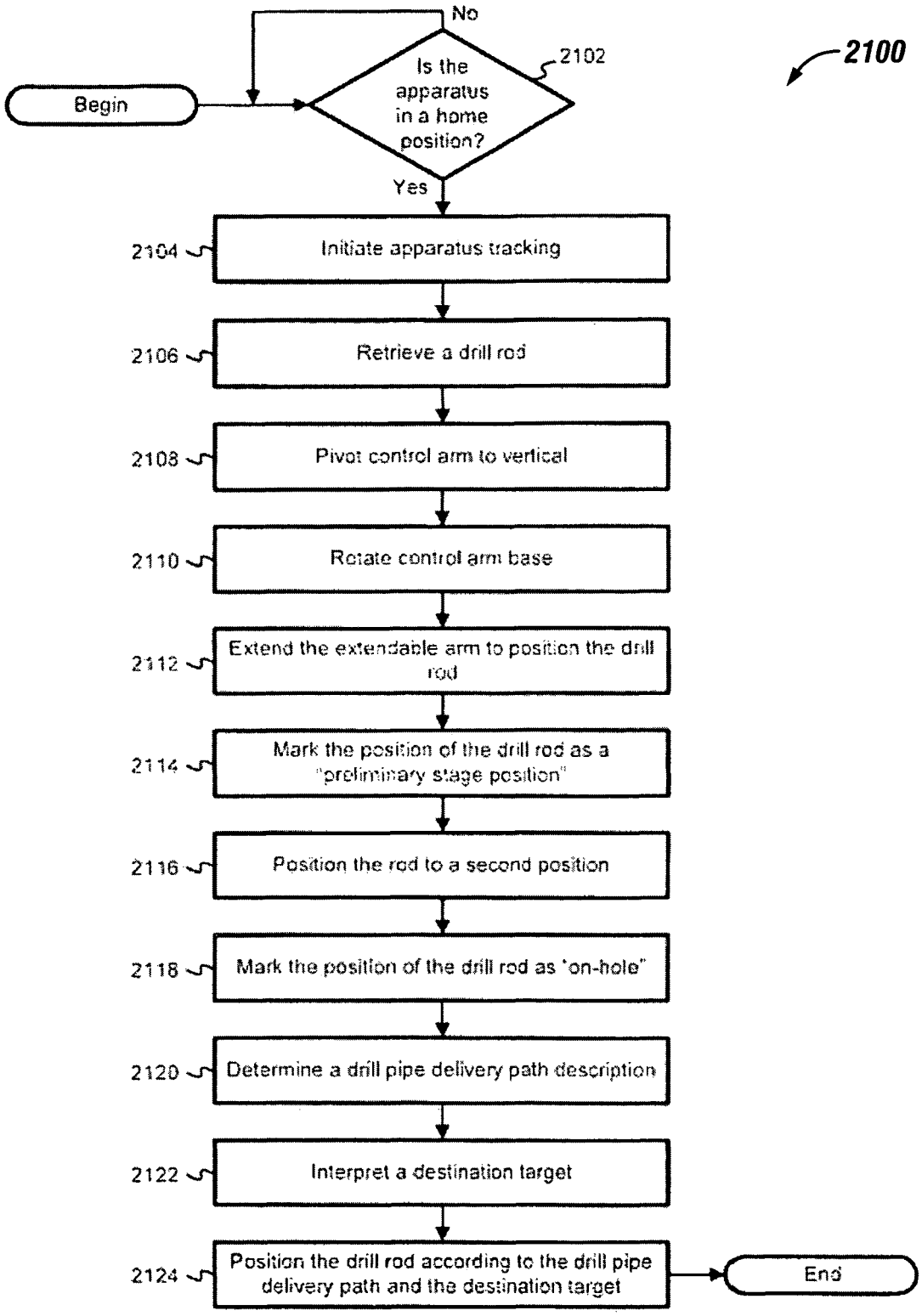
FIG. 16 is a second schematic flow diagram of a procedure for automated rod handling.

The schematic flow diagrams and related descriptions in FIGS. 15 and 16 which follow provide illustrative embodiments of performing operations for automatic drill rod handling. Operations illustrated are understood to be exemplary only, and operations may be combined or divided, added or removed, as well as re-ordered in whole or in part, unless stated explicitly to the contrary.

Referencing FIG. 15, shown therein is one example of a procedure 2000 to load and/or unload drill pipe. The procedure includes an operation 2002 to position a drill pipe between vertical dividers in an apparatus. The procedure further includes an operation 2004 to orient the control arm horizontally and rotated such that the clamping jaws are facing downward. The procedure further includes an operation 2006 to position the moveable structure such that the pipe lifting mechanism and control arm are located in line with the drill pipe. The procedure further includes an operation 2008 to raise the lifting beam until the drill pipe is to fully inserted into the clamping jaws. The procedure further includes an operation 2010 to close the clamping jaws and secure the drill pipe. In certain embodiments, the procedure may include an operation 2012 to lower the lifting beam to provide sufficient clearance to allow pivoting of the control arm. The procedure further includes an operation 2014 to raise the control arm to a vertical position. In certain embodiments, the procedure includes an operation 2016 to move the control arm to a home position, and an operation 2018 to rotate the control arm to an azimuthal angle facing a drilling area. The procedure further includes an operation 2020 to extend the extendable bar toward the drilling area. In certain embodiments, the procedure further includes an operation 2022 to trim the position of the control arm, including adjustments to rotation angle and/or extension, and to position the drill pipe below a tophead on a drill rig, to a top of a pipe extending from a well, and/or to another operationally desirable position. In certain embodiments, the procedure includes an operation to release the clamping jaws and retract the control arm. The illustrated procedure includes operations associated with an embodiment of a procedure, and operations may be combined, skipped, re-ordered, and/or subdivided in certain embodiments.

The following describes the control process or procedure associated with the system 100 according to one form of the present invention to store and manipulate a plurality of drill pipe from the rack. In certain embodiments, the system 100 includes sensors and actuators to determine the status and position of various components of the system 100 and to operate various actuators in the system 100. In certain embodiments, sensors may provide data to a controller 126 by any means understood in the art including, for example, electronic signals, datalink signals and/or network communications. The controller 126 may be in communication with any aspect of the system 100. Without limitation, the position or other state of any component may be monitored, and the sensors may be real (i.e., directly measuring the parameter of interest) and/or virtual (i.e., determining the parameter of interest based on related parameters). The controller 126 may include electronic processing, electronic input and output, and/or computer readable memory. Additionally, the controller 126 may include a single computer or a plurality of computers, and may include distributed components including components stationed remotely that communicate with the location of the drilling rig through a network or other means. In certain embodiments, the controller 126 detects and/or records the state of the system 100 (or portions thereof) during operation.

Referring to FIG. 16, a procedure 2100 is shown according to one form of the present invention for loading and/or unloading drill pipe. The procedure 2100 includes an operation 2102 to determine whether the system 100 is in a home position, and an operation 2104 to initiate apparatus tracking in response to determining whether the system 100 is in the home position. The determination of the home position includes, without limitation, accepting a user input (e.g., a push-button available to an operator) indicating that the system 100 is in home position and/or determining that the system 100 is in a home position based upon feedback from various sensors. For example, a determination that the system 100 is in a home position may be made in response to sensor indications that: the control arm 114 is horizontal, the control arm base 118 is in a position such that the control arm 114 is faced downward, the extendable bar 120 is retracted, and/or the clamping jaws 124 are fully open.

The procedure 2100 includes an operation 2106 to retrieve a drill rod and an operation 2108 to pivot the control arm 114 to a vertical position. The operations 2106, 2108 may be performed by an operator utilizing controls and/or by the controller 126. In certain embodiments, an operator performs the operations 2106, 2108 and a controller 126 records the operations 2106, 2108. The operations 2106, 2108 may be recorded as starting and ending positions of the control arm 114, a time based trajectory of control arm 114 positions, and/or other parameters describing the state of the system 100 during operations 2106, 2108.

In certain embodiments, the procedure 2100 further includes an operation 2110 to rotate the control arm base 118 until the control arm 114 is pointed in a desired azimuthal direction, and an operation 2112 to extend the extendable bar 120 until the drill pipe is positioned at a desired position. In certain embodiments, the procedure 2100 includes an operation 2114 to mark the position of the drill pipe, for example storing the position as a first destination position. In certain embodiments, the first destination position of the drill pipe may be a position indicated by the settings of the control arm, control arm base, the extendable arm, and/or the first destination of the drill pipe may be a position stored as the positional trajectory (e.g., allowing the drill pipe to be maneuvered around an obstacle en route to the marked position), which may further include a positional trajectory with time. In certain embodiments, the operation 2114 to mark the positions of the drill pipe is made in response to an operator input, and/or in response to a determination that the drill pipe is in a position matching a pre-determined position such as a position received in a communication to the controller 126 and/or a position stored in a memory location on the controller 126. The first destination position may be labeled, for example, as a "Preliminary Stage" position.

In certain embodiments, the procedure 2100 further includes an operation 2116 to position the rod at a second destination position. In certain embodiments, the procedure 2100 includes an operation 2118 to mark the position of the drill pipe, for example storing the position as a second destination position. In certain embodiments, the second destination position of the drill pipe may be a position indicated by the settings of the control arm, control arm base, the extendable arm, and/or the second destination of the drill pipe may be a position stored as the positional trajectory (e.g., allowing the drill pipe to be maneuvered around an obstacle en route to the marked position), which may further include a positional trajectory with time. In certain embodiments, the operation 2118 to mark the positions of the drill pipe is made in response to an operator input, and/or in response to a determination that the drill pipe is in a position matching a predetermined position such as a position received in a communication to the controller 126 and/or a position stored in a memory location on the controller 126. The second destination position may be labeled, for example, as a "final" or "on-hole" destination. The marking of two destination positions are described herein, but in certain embodiments other numbers of destination positions, including a single destination position and more than two destination positions, may be utilized.

The procedure 2100, in certain embodiments, includes an operation 2120 to determine a drill pipe delivery path description comprising information to deliver a drill pipe from storage on the system 100 to each of the destination positions. The drill pipe delivery path description includes, in certain embodiments, angle and extension information for each destination position. The controller 126 may calculate the drill pipe delivery path description, which may include corrections such that the system 100 can deliver a drill pipe each destination position from any row of the drill pipe storage area of the system 100. In certain embodiments, the corrections based on the row of the drill pipe storage area include returning the moveable structure 116 to a home position each time before rotating the control arm base 118 and/or extending the extendable bar 120. In certain embodiments, the corrections based on the row of the drill pipe storage area include adjusting a rotation angle of the control arm base 118 and adjusting an amount of extension of the extendable bar 120 such that the drill pipe is positioned in the desired destination position.

In certain embodiments, the procedure 2100 further includes an operation 2122 to interpret a destination target, and an operation 2124 to position the drill pipe according to the destination target. For example, an operator may push a button designating a "Preliminary Stage" position as a destination target, and the controller 126 may operate actuators for the control arm, control arm base, and extendable arm to deliver a drill pipe to the first desired position. In another example, an operator may push a button designating an "On-Hole" position as a destination target, and the controller 126 may operate actuators for the control arm, control arm base, and extendable arm to deliver a drill pipe to the second desired position. In another example, an operator may push a button designating a "Return to Rack" position as a destination target, and the controller 126 may operate actuators for the control arm, control arm base, and extendable arm to deliver a drill pipe back to the drill pipe storage area of the system 100 in response thereto.

In certain embodiments, the controller 126 may be configured to select drill pipes from various rows of the drill pipe storage area in a predetermined order (e.g., to keep the rack balanced, to use a first drill pipe size first and a second drill pipe size second, to add drill pipes with certain features in a certain order, etc.). In certain embodiments, the controller 126 may be configured to learn a pipe delivery operation via a teach-and-learn function based on responses from an operator. Operator interfaces described herein are provided for purposes of examples only. For example, an operator may select from menus on a laptop computer, or use any other form of input to the system 100 generally understood in the art.

In certain embodiments, the operator will position the rod to its position in alignment under the drill head. The operator will press a button to indicate to the CPU that the rod is at its final or "On-Hole" destination. The CPU will begin to solve multiple math algorithms and populate data fields. With the information in the data fields, the arm can find the desired location from any row at the base of the remote rod handling system automatically. The operator can run the machine with a push of either the "Preliminary Stage" button or the "On-Hole" button for the remembered locations. The CPU will make the appropriate calculations and adjustments necessary for automated operation. In certain embodiments, these adjustments may be angular and/or linear.

As is evident from the figures and text presented above, a variety of embodiments according to the present invention are contemplated.

One exemplary embodiment is an apparatus including a rack having a plurality of storage rows suitable for storing drill pipe therein; a moveable structure at a first end of the rack, wherein the moveable structure travels along a guide to be positioned at the first end of any of the storage rows; a control support coupled to an upper portion of the moveable structure, the control support comprising a pivoting actuator, a rotating actuator, an extension arm comprising a drill pipe capture actuator, and an extension actuator that extends the extension arm; a lifting device coupled to a bottom portion of the moveable structure, the lifting device including a lifting actuator that raises a stack of drill pipe positioned in one of the storage rows; a controller structured to: record a first position of the control support; record a second position of the control support; interpret a position request signal; and command actuators to return the control support to one of the first position and the second position in response to the position request signal.

In further embodiments, the apparatus includes a row positioning actuator structured to position the moveable structure at a selected row from the storage rows. The apparatus may include the extension actuator and the lifting actuator being hydraulic actuators engaging scissor bars. In certain embodiments, the first position is a preliminary position and the second position is an on-hole position. In a further embodiment, the rack includes a second end moveable such that a distance between the first end and the second end is adjustable. The apparatus may include a vertical trim actuator coupled to the moveable structure, where the vertical trim actuator engages the control support when the control support is pivoted to a vertical position.

One exemplary embodiment is a system, including: a rack having storage rows suitable for storing drill pipe; a moveable structure at a first end of the rack, where the moveable structure travels along a guide to be positioned at the first end of any the storage rows; a control support coupled to an upper portion of the moveable structure, where the control support includes a pivoting actuator, a rotating actuator, an extension arm including a drill pipe capture actuator, and an extension actuator that extends the extension arm; a lifting device coupled to a bottom portion of the moveable structure, the lifting device including a lifting actuator structured to raise a stack of drill pipe positioned in one of the storage rows; a controller, including: a position determination module that interprets a control support state including positions of the pivoting actuator, the rotating actuator, and the extension actuator; a position indicator module that interprets a position index value; a position recording module that records a position description including the control support state corresponding to the position index value; a position request module that interprets a position request signal; and a position control module that provides actuator control signals in response to the position request signal and the position description.

In certain embodiments, the system further includes a plurality of position index values, each position index value corresponding to a specified operational stage of a drilling operation. The system may include the plurality of position index values having at least two index values selected from a preliminary stage position, an on-hole position, an intermediate position, a home position, and/or a return to rack position. The system may further include a user interface that receives user input and provides the position index value and/or the position request signal in response to the user input. In certain embodiments, the position description further includes a trajectory of actuator positions through space and/or time.

The position recording module records the position description in response to a teach and learn operation. The system may include a pipe ordering module that interprets a pipe ordering description, and the position control module may further provide a row positioning actuator control signal in response to the pipe ordering description. In certain embodiments, the position request module further adjusts the position description in response to the row positioning actuator control signal. In further embodiments, the position control module may adjust the actuator control signal in response to the row positioning actuator control signal.

One exemplary embodiment is a method including positioning a drill pipe handling apparatus near a wellhead, the drill pipe handling apparatus having a pivoting actuator that pivots a control support, a rotating actuator that rotates the control support, and an extending actuator that extends a drill pipe capture device comprising a portion of the control support; lifting a drill pipe from a rack to the drill pipe capture device; pivoting, rotating, and extending the control support to a first position; recording the positions of the pivoting actuator, a rotating actuator, and an extending actuator as a first position description; receiving a position request signal; and returning the drill pipe handling apparatus to the first position in response to the position request signal and the first position description.

The method may further include pivoting, rotating, and extending the control support to a second position; recording the positions of the pivoting actuator, the rotating actuator, and the extending actuator as a second position description; and returning the drill pipe handling apparatus to one of the first position and the second position in response to the position request signal and one of the first position description and the second position description. In certain embodiments, the method further includes activating a teaching mode and recording the positions of the pivoting actuator, a rotating actuator, and an extending actuator in response to the teaching mode. The exemplary method further includes recording a plurality of position descriptions, each position description corresponding to one of a plurality of position index values; receiving a user input indicating one of the position index values; and returning the drill pipe handling apparatus to the position description corresponding to the indicated position index value. The method may further include interpreting a pipe ordering description that includes an ordering of a plurality of rows of the rack, and performing one of: removing drill pipes from the rack according to the pipe ordering description and replacing drill pipes to the rack according to the pipe ordering description. In a further embodiment, the method includes recording a first selected row of the rack as a portion of the first position description and adjusting the first position description in response to a currently selected row of the rack.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. Any theory, mechanism of operation, proof or finding stated herein is meant to further enhance understanding of the present invention, and is not intended to make the present invention in any way dependent upon such theory, mechanism of operation, proof or finding.

It should be understood that while the use of the word preferable, preferably or preferred in the description above indicates that the feature so described may be more desirable, it nonetheless may not be necessary, and embodiments lacking the same may be contemplated as within the scope of the application, that scope being defined by the claims that follow. In reading the claims, it is intended that when words such as "a", "an", "at least one", and "at least a portion" are used, there is no intention to limit the claim to only one item unless specifically stated to the contrary in the claim. Further, when the language "at least a portion" and/or "a portion" is used, the item may include a portion and/or the entire item unless specifically stated to the contrary.

What is claimed is:

1. An apparatus, comprising:

a rack having a plurality of storage rows suitable for storing drill pipe therein;

a moveable structure adjacent a first end of the rack, wherein the moveable structure travels along a guide to be positioned adjacent the first end of any of the storage rows;

a control support pivotally and rotationally coupled to an upper portion of the moveable structure, the control support comprising an extension arm comprising a drill pipe capture device, and an extension actuator structured to extend the extension arm;

a lifting device coupled to a bottom portion of the moveable structure, the lifting device comprising a lifting actuator structured to raise a stack of drill pipe positioned in one of the storage rows;

wherein the extension actuator and the lifting actuator comprise hydraulic actuators engaging scissor bars; and a controller, comprising:

a position determination module structured to interpret a control support state comprising positions of the control support;

a position recording module structured to record a position description comprising a first position of the control support and a second position of the control support;

a position request module structured to interpret a position request signal; and a position control module structured to command actuators to return the control support to one of the first position and the second position in response to the position request signal.

2. The apparatus of claim 1, wherein the moveable structure is structured for positioning at a selected row from the storage rows.

3. The apparatus of claim 1, wherein the first position comprises a preliminary position and wherein the second position comprises an on-hole position.

4. The apparatus of claim 1, wherein the rack further comprises a second end moveable such that a distance between the first end and the second end is adjustable.

5. The apparatus of claim 1, further comprising a vertical trim actuator coupled to the moveable structure, wherein the vertical trim actuator engages the control support when the control support is pivoted to a vertical position.

6. A system, comprising:

a rack having a plurality of storage rows suitable for storing drill pipe therein;

a moveable structure adjacent a first end of the rack, wherein the moveable structure travels along a guide to be positioned adjacent the first end of any of the storage rows;

a control support coupled to an upper portion of the moveable structure, the control support comprising a pivoting actuator, a rotating actuator, an extension arm comprising a drill pipe capture actuator, and an extension actuator structured to extend the extension arm;

a lifting device coupled to a bottom portion of the moveable structure, the lifting device comprising a lifting actuator structured to raise a stack of drill pipe positioned in one of the storage rows;

a controller, comprising:

a position determination module structured to interpret a control support state comprising positions of the pivoting actuator, the rotating actuator, and the extension actuator;

a position indicator module structured to interpret a position index value;

a position recording module structured to record a position description comprising the control support state corresponding to the position index value;

a position request module structured to interpret a position request signal; and a position control module structured to provide a plurality of actuator control signals in response to the position request signal and the position description.

7. The system of claim 6, further comprising a plurality of position index values, each position index value corresponding to a specified operational stage of a drilling operation.

8. The system of claim 6, wherein the plurality of position index values comprise at least two index values selected from the list consisting of a preliminary stage position, an on-hole position, an intermediate position, a home position, and a return to rack position.

9. The system of claim 6, further comprising a user interface structured to receive a user input and to provide at least one of the position index value and the position request signal in response to the user input.

10. The system of claim 6, wherein the position description further comprises a trajectory of actuator positions through at least one of space and time.

11. The system of claim 10, wherein the position recording module records the position description in response to a teach and learn operation.

12. The system of claim 6, further comprising a pipe ordering module structured to interpret a pipe ordering description, and wherein the position control module is further configured to provide a row positioning actuator control signal in response to the pipe ordering description.

13. The system of claim 12, wherein the position request module is further structured to adjust the position description in response to the row positioning actuator control signal.

14. The system of claim 12, wherein the position control module is further structured to adjust the actuator control signals in response to the row positioning actuator control signal.

* * * * *